US009625864B2

(12) United States Patent
Ishida et al.

(10) Patent No.: US 9,625,864 B2
(45) Date of Patent: Apr. 18, 2017

(54) BELT FRAME FOR FIXING DEVICE

(71) Applicant: Brother Kogyo Kabushiki Kaisha, Nagoya-shi, Aichi-ken (JP)

(72) Inventors: Kei Ishida, Inuyama (JP); Takuji Matsuno, Ichinomiya (JP); Hiroki Mori, Nagoya (JP); Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/015,698

(22) Filed: Feb. 4, 2016

(65) Prior Publication Data

US 2016/0231675 A1 Aug. 11, 2016

(30) Foreign Application Priority Data

Feb. 6, 2015 (JP) ..... 2015-022601

(51) Int. Cl.
*G03G 15/00* (2006.01)
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2052; G03G 15/2035; G03G 15/2064; G03G 15/2017; G03G 15/2032
USPC ..... 399/122, 328–331
See application file for complete search history.

(56) References Cited

U.S. PATENT DOCUMENTS 5,351,114 A * 9/1994 Matsuno ..... G03G 15/2064 399/307
2012/0308275 A1* 12/2012 Suzuki et al. ..... G03G 15/2017 399/329
2013/0071156 A1* 3/2013 Suzuki et al. ..... G03G 15/2053 399/329
2013/0136512 A1 5/2013 Suzuki et al.

FOREIGN PATENT DOCUMENTS

JP H04-221983 A 8/1992
JP 2013-114058 A 6/2013

* cited by examiner

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

A fixing device includes an endless belt, a heating plate, a pressure roller, a first belt guide and a second belt guide. The endless belt has a tubular shape and extends in a first direction. The heating plate is disposed inside the endless belt and extends in the first direction. The first belt guide guides an end of the endless belt in the first direction and includes an inner guide and a restriction portion to restrict movement of the endless belt in the first direction. The second belt guide faces the first belt guide in a second direction and extends from a vicinity of the heating plate to a vicinity of the inner guide along the inner peripheral surface of the endless belt. An end of the restriction portion in the second direction closer to the heating plate is located closer to the second belt guide than the inner guide.

20 Claims, 7 Drawing Sheets

BELT FRAME FOR FIXING DEVICE

CROSS-REFERENCE TO RELATED APPLICATION

This application claims priority from Japanese Patent Application No. 2015-022601 filed on Feb. 6, 2015, the content of which is incorporated herein by reference in its entirety.

FIELD OF DISCLOSURE

The disclosure relates to a fixing device for use in an electrophotographic image forming apparatus.

BACKGROUND

A known fixing device for use in an image forming apparatus is configured to heat a film with a nip plate contacting an inner peripheral surface of the film.

The fixing device includes a first film guide configured to guide the rotation of the film at each end of the nip plate, a second film guide having a generally semicircular shape and configured to guide the rotation of an end of the film, and a restricting member disposed at a position corresponding to the second film guide and configured to restrict the movement of the film to its longitudinal direction.

SUMMARY

According to one or more aspects of the disclosure, a fixing device may include an endless belt, a heating plate, a pressure roller, a first belt guide, and a second belt guide. The endless belt may have a tubular shape and extend in a first direction. The heating plate may be disposed inside the endless belt and extend in the first direction. The pressure roller may contact an outer peripheral surface of the endless belt such that the endless belt may be disposed between the pressure roller and the heating plate. The first belt guide may be configured to guide an end of the endless belt in the first direction. The first belt guide may include an inner guide disposed along a portion of an inner peripheral surface of the endless belt, and a restriction portion connected to the inner guide and disposed outside the endless belt in the first direction. The restriction portion may be configured to restrict movement of the endless belt in the first direction. The second belt guide may face the first belt guide in a second direction in which the endless belt and the pressure roller may face each other. The second belt guide may be located at each end portion of the heating plate along the first direction and extend from a vicinity of the heating plate to a vicinity of the inner guide along the inner peripheral surface of the endless belt. An end of the restriction portion in the second direction closer to the heating plate may be located closer to the second belt guide than the inner guide.

According to one or more other aspects of the disclosure, a fixing device may include an endless belt, a belt guide, and a restriction portion. The endless belt may have a tubular shape and extending in a first direction. The belt guide may be disposed along an inner peripheral surface of the endless belt and configured to guide the endless belt. The restriction portion may be disposed outside the endless belt in the first direction and configured to restrict movement of the endless belt in the first direction. The restriction portion may extend above an upper end of the endless belt and extend below a lower end of the endless belt.

DETAILED DESCRIPTION

1. General Structures of Image Forming Apparatus

The printer 1 is an electrophotographic monochrome printer.

Figure 1:
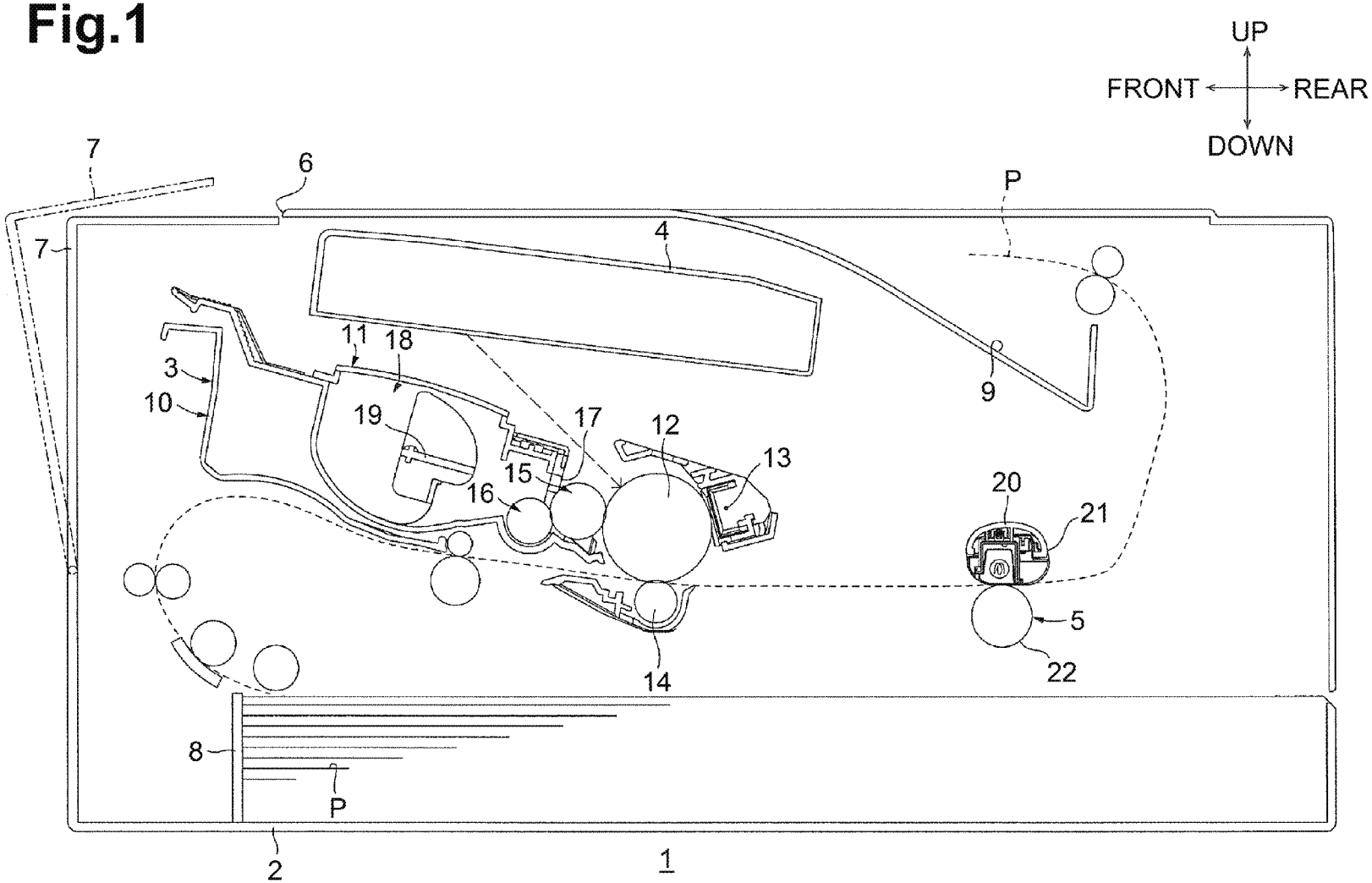
FIG. 1 is a central cross-sectional view of an image forming apparatus including a fixing device in a first illustrative embodiment according to one or more aspect of the disclosure.

In the following description, front, rear, left, right, top/upper, and bottom/lower sides of the printer 1 may be defined in conjunction with an orientation in which the printer 1 is placed horizontally. More specifically, upper and lower sides of FIG. 1 are defined as top/upper and bottom/lower sides of the printer 1, respectively. Left and right sides of FIG. 1 are defined as front and rear sides of the printer 1, respectively. Left and right sides when the printer 1 is viewed from the front side, e.g., front and back sides of the sheet of FIG. 1, are defined as left and right sides of the printer 1, respectively. The left-right direction may be an example of a first direction. The top-bottom direction may be an example of an arrangement direction and a second direction. The front-rear direction may be an example of a third direction. A lower side may be an example of one side in the second direction. An upper side may be an example of another side in the second direction. A front-to-rear direction may be an example of a sheet conveying direction. The direction indicated by an arrow in FIG. 6A may be a rotation direction of the endless belt 21. A direction in which the endless belt 21 and the pressure roller 22 face each other is also an example of the second direction.

The printer 1 includes a main casing 2, a process cartridge 3, a scanner unit 4, and a fixing device 5.

The main casing 2 has a generally box shape. The main casing 2 includes an opening portion 6, a front cover 7, a supply tray 8, and a discharge tray 9.

The opening portion 6 is disposed at a front end portion of the main casing 2. The opening portion 6 allows an interior and an exterior of the main body 2 to communicate with each other in the front-rear direction, so that the process cartridge 3 may pass through the opening operation 6.

The front cover 7 is disposed at a front end portion of the main casing 2. The front cover 7 has a generally L-shaped plate shape in side sectional view. The front cover 7 is pivotally supported about a lower end portion thereof by a front wall of the main casing 2. The front cover 7 is configured to open or close the opening portion 6.

The supply tray 8 is disposed at a bottom portion of the main casing 2. The supply tray 8 is configured to accommodate a stack of sheets P therein.

The discharge tray 9 is disposed at an upper wall of the main casing 2. The discharge tray 9 is recessed downward from an upper surface of the main casing 2 to receive a sheet P.

The process cartridge 3 is accommodated in a central portion of the main casing 2 in the top-bottom direction. The process cartridge 3 is configured to be mounted to or removed from the main casing 2, via the opening portion 6. The process cartridge 3 includes a drum cartridge 10 and a developing cartridge 11.

The drum cartridge 10 includes a photosensitive drum 12, a scorotron charger 13, and a transfer roller 14.

The photosensitive drum 12 is rotatably supported by a rear end portion of the drum cartridge 10. The photosensitive drum 12 has a generally cylindrical shape extending in the left-right direction.

The scorotron charger 13 is disposed behind the photosensitive drum 12 with a space therebetween.

The transfer roller 14 is disposed below the photosensitive drum 12. The transfer roller 14 is in contact with a lower end portion of the photosensitive drum 12.

The developing cartridge 11 is mounted to the drum cartridge 10 in front of the photosensitive drum 12. The developing cartridge 11 includes a developer roller 15, a supply roller 16, a layer-thickness regulating blade 17, a toner chamber 18, and an agitator 19.

The developer roller 15 is rotatably supported by a rear end portion of the developing cartridge 11. The developer roller 15 has a generally cylindrical shape extending in the left-right direction. The developer roller 15 is in contact with a front end portion of the photosensitive drum 12.

The supply roller 16 is disposed diagonally below and in front of the developer roller 15. The supply roller 16 is rotatably supported by the developing cartridge 11. The supply roller 16 has a generally cylindrical shape extending in the left-right direction. The supply roller 16 is in contact with a lower front end portion of the developer roller 15.

The layer-thickness regulating blade 17 is disposed above and in front of the developer roller 15. The layer-thickness regulating blade 17 is in contact with a front end portion of the developer roller 15.

The toner chamber 18 is disposed in front of the supply roller 16 and the layer-thickness regulating blade 17. The toner chamber 18 is configured to accommodate toner therein.

The agitator 19 is rotatably supported in the toner chamber 18.

The scanner unit 4 is disposed above the process cartridge 3. The scanner unit 4 is configured to emit laser beam toward the photosensitive drum 12 based on image data.

The fixing device 5 is disposed at a rear portion of the main casing 2. As will be described below in detail, the fixing device 5 includes an endless belt 21, a heating unit 20 configured to heat the endless belt 21, and a pressure roller 22 disposed below the heating unit 20 and sandwiching the endless belt 21 between the pressure roller 22 and the heating unit 20.

When the printer 1 starts an image forming operation, the scorotron charger 13 uniformly charges a surface of the photosensitive drum 12. The scanner unit 4 exposes the surface of the photosensitive drum 12 to light based on image data. Thus, an electrostatic latent image based on the image data is formed on the surface of the photosensitive drum 12.

The agitator 19 agitates toner in the toner chamber 18, and supplies the toner to the supply roller 16. The supply roller 16 supplies the toner supplied by the agitator 19 to the developer roller 15. At this time, the toner is positively charged between the developer roller 15 and the supply roller 16 by friction, and carried on the developer roller 15. The layer-thickness regulating blade 17 regulates the thickness of a layer of the toner carried on the developer roller 15 to a constant thickness.

The toner carried on the developer roller 15 is supplied to an electrostatic latent image on the surface of the photosensitive drum 12. Thus, a toner image is carried on the surface of the photosensitive drum 12.

The sheets P are supplied one by one between the photosensitive drum 12 and the transfer roller 14 at a predetermined timing from the supply tray 8 with the rotation of various rollers. The toner image on the surface of the photosensitive drum 12 is transferred to a sheet P when the sheet P passes between the photosensitive drum 12 and the transfer roller 14.

Thereafter, when the sheet P passes between the heating unit 20 and the pressure roller 22, heat and pressure are applied to the sheet P. Thus, the toner image on the sheet P is thermally fixed on the sheet P. Thereafter, the sheet P is discharged on the discharge tray 9.

2. Details of Fixing Device

Figure 6A:
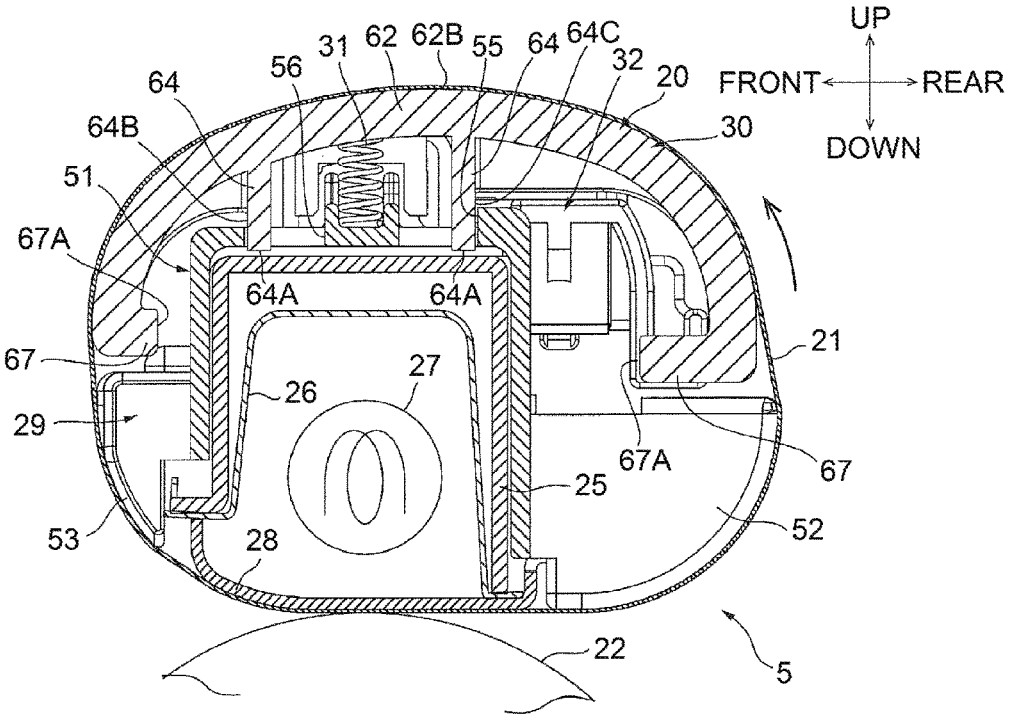
FIG. 6A is a cross-sectional view taken along a line C-C of FIG. 4B, wherein a belt guide is in a second position.

As depicted in FIGS. 1 and 6A, the fixing device 5 includes the heating unit 20, the endless belt 21, and the pressure roller 22, as described above.

(1) Heating Unit

Figure 2:
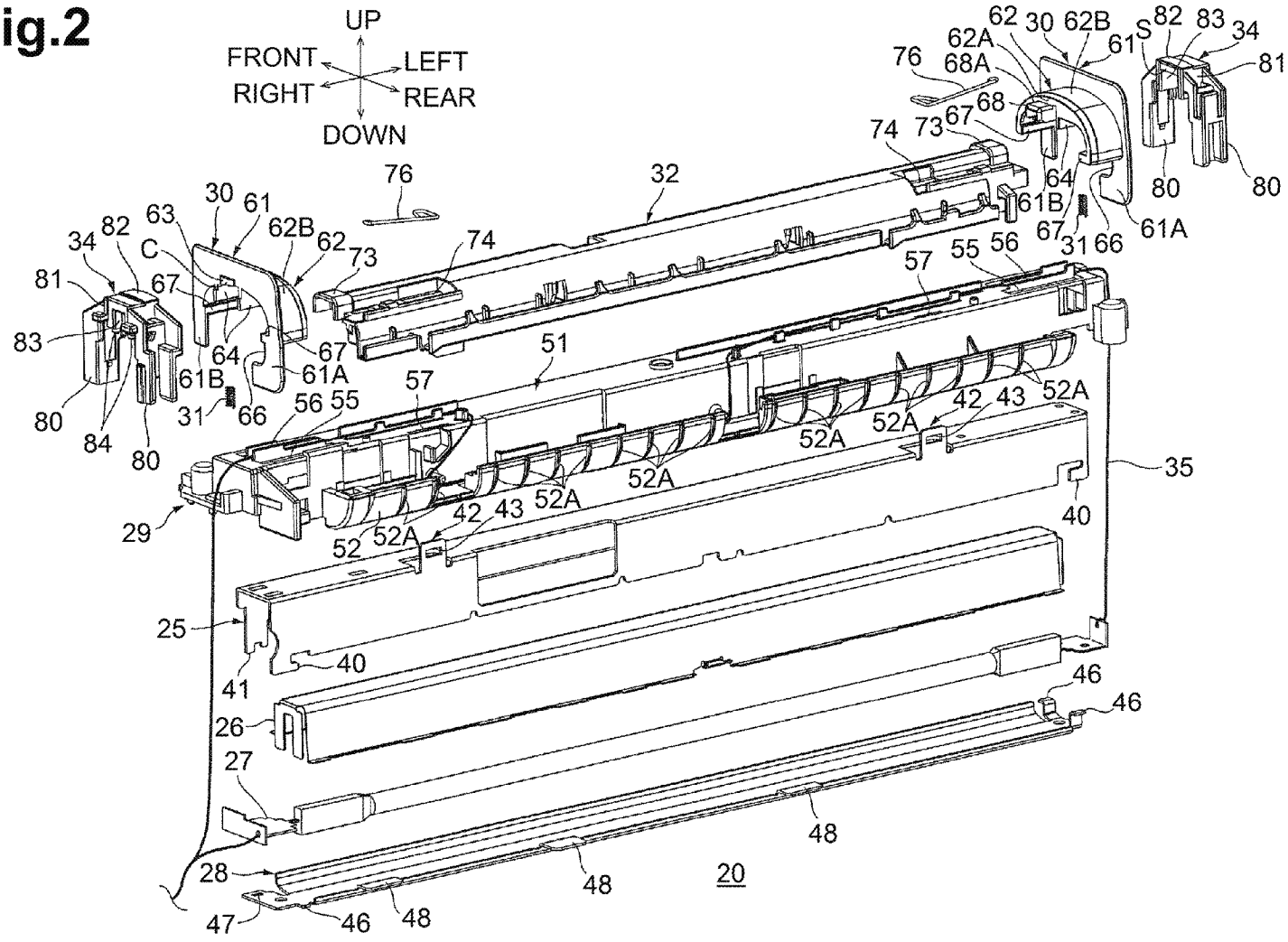
FIG. 2 is an exploded perspective view of a heating unit depicted in FIG. 1 as viewed from an upper right side.

As depicted in FIGS. 2 and 6A, the heating unit 20 includes a stay 25, a reflective plate 26, a halogen heater 27, a heating plate, e.g., a nip plate 28, a first frame, e.g., a stay cover 29, a second frame, e.g., a pressing cover 32, first belt guides, e.g., two belt guides 30, two urging members 31, two opposing members 34, and a wiring 35.

The stay 25 includes a metallic material having high stiffness, e.g., stainless steel and iron. As depicted in FIG. 2, the stay 25 extends in the left-right direction and has a generally rectangular tubular shape with an open lower end. The stay 25 includes three hook-shaped portions 40, one extending portion 41, and two upright portions 42.

Each of the three hook-shaped portions 40 is disposed at right and left lower end portions of a rear wall of the stay 25, and a left lower end portion of a front wall of the stay 25 (not depicted), respectively. Each of the three hook-shaped portions 40 extends downward from a respective lower end portion of the stay 25 and inwardly in the left-right direction (e.g., toward the center of the stay 25 in the left-right direction).

The extending portion 41 is disposed at a right lower end portion of the front wall of the stay 25. The extending portion 41 has a generally rectangular plate shape extending downward in a lower end portion of the stay 25, in front view.

The two upright portions 42 are disposed with a space therebetween in the left-right direction. One of the upright portions 42 is disposed at a generally central portion, in the left-right direction, of a left half of the stay 25 and the other one of the upright portions 42 is disposed at a generally central portion, in the left-right direction, of a right half of the stay 25. Each upright portion 42 is continued from the rear wall of the stay 25 and extends upward. Each upright portion 42 has a generally rectangular plate shape protruding upward relative to an upper wall of the stay 25, in front view. Each upright portion 42 has a through hole 43.

The through hole 43 passes through a generally central portion of a respective one of the upright portions 42. The through hole 43 has a generally rectangular shape in front view.

The reflective plate 26 includes a metallic material. The reflective plate 26 extends in the left-right direction and has a generally rectangular tubular shape with an open lower end. An inner surface of the reflective plate 26 is mirror finished. The reflective plate 26 is disposed inside the stay 25, as depicted in FIG. 6A.

As depicted in FIGS. 2 and 6A, the halogen heater 27 includes a glass tube extending in the left-right direction and having a generally cylindrical shape with closed left and right end portions, a filament disposed inside the glass tube, and electrodes, each disposed at a respective one of left and right end portions of the glass tube. The halogen heater 27 is configured to generate heat with the application of electricity. The halogen heater 27 is disposed inside the reflective plate 26, as depicted in FIG. 6A.

The nip plate 28 includes metallic material. As depicted in FIGS. 2 and 6A, the nip plate 28 has a generally rectangular plate shape extending in the left-right direction, in plan view. As depicted in FIG. 2, the nip plate 28 includes three first catches 46, one through hole 47, and three second catches 48.

Each of the three first catches 46 is disposed at a respective one of right and left rear end portions, and a left front end portion of the nip plate 28. The first catch 46 disposed at the right rear end portion protrudes rearward from a right rear end portion of the nip plate 28. The first catch 46 disposed at the left rear end portion extends upward from a left rear end portion of the nip plate 28 and then rearward. The first catch 46 disposed at the left front end portion extends upward from a left front end portion of the nip plate 28 and then frontward.

The through hole 47 is located at a right front end portion of the nip plate 28. The through hole 47 passes through the nip plate 28 and has a generally rectangular shape and in plan view.

The three second catches 48 are disposed at respective rear end portions of the nip plate 28 and spaced apart from each other in the left-right direction. Each second catch 48 has a generally rectangular plate shape extending rearward from a respective rear end portion of the nip plate 28 in plan view.

Each of the three first catches 46 engages a corresponding one of the hook-shaped portions 40 of the stay 25, and the through hole 47 receives the extending portion 41 of the stay 25, so that the nip plate 28 is supported by the stay 25 with the reflective plate 26 placed therebetween, as depicted in FIG. 6A.

With this structure, the nip plate 28 disposed at a lower end portion of the heating unit 20 is configured to be heated to high temperatures by radiant heat from the halogen heater 27 reflected off the inner surface of the reflective plate 26.

The stay cover 29 includes heat-resistant resin material. As depicted in FIGS. 2 and 6A, the stay cover 29 extends in the left-right direction and has a generally box shape with an open lower end portion. The stay cover 29 includes a cover portion 51, and a second belt guide, e.g., a first slide portion 52 and a second slide portion 53. The slide portion 52, the second slide portion 53 and the nip plate 28 are also examples of a lower belt guide.

The cover portion 51 extends in the left-right direction and has a generally box shape with an open lower end portion. The cover portion 51 includes two guide grooves 55, as an example of grooves and guide portions, two holding portions 56, and two first insertion holes 57.

Each of the two guide grooves 55 is located at left and right end portions of an upper wall of the cover portion 51. Each guide groove 55 passes through the upper wall of the cover portion 51, and has a generally rectangular shape extending in the left-right direction in plan view.

Each of the two holding portions 56 sandwiches a corresponding one of the guide grooves 55 in the left-right direction. Each holding portion 56 has a generally rectangular tubular shape with an open upper end. Each holding portion 56 extends in the left-right direction.

The two first insertion holes 57 are located with a space therebetween in the left-right direction, as depicted in FIG. 2. One of the two first insertion holes 57 is disposed at a generally central portion of a left half of the cover portion 51 and the other one of the two first insertion holes 57 is disposed at a generally central portion of a right half of the cover portion 51. Each first insertion hole 57 passes through a rear end portion of the upper wall of the cover portion 51 and has a generally rectangular shape extending in the left-right direction in plan view.

Figure 4A:
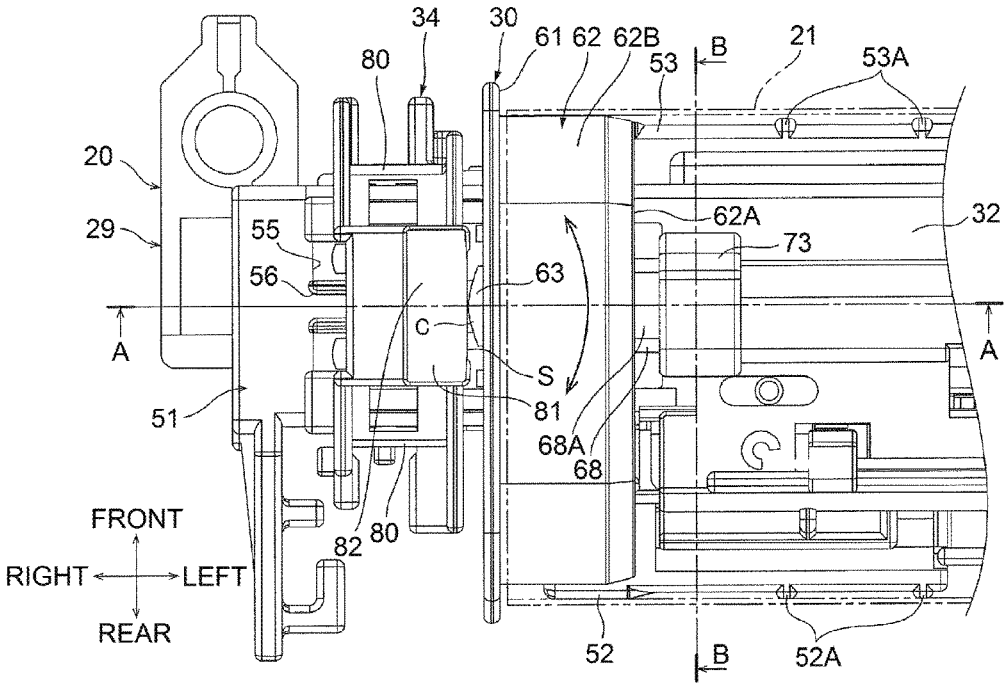
FIG. 4A is a partially enlarged plan top view of the heating unit depicted in FIG. 3A.

As depicted in FIGS. 2 and 6A, the first slide portion 52 extends from a lower end portion of a rear wall of the cover portion 51 rearwardly and upwardly, while curving. The first slide portion 52 extends in the left-right direction. The first slide portion 52 has a generally cylindrical sector shape in side view with closed left and right end portions. As depicted in FIG. 2, a right end portion of the first slide portion 52 is located further toward the left than a right end portion of the cover portion 51, and a left end portion of the first slide portion 52 is located further toward the right than a left end portion of the cover portion 51. As depicted in FIGS. 2 and 4A, the first slide portion 52 includes guide ribs, e.g., a plurality of first guide ribs 52A.

The first guide ribs 52A are spaced apart from each other in the left-right direction. Each first guide rib 52A protrudes from an outer peripheral surface of the first slide portion 52 and extends along a rotation direction of the endless belt 21.

As depicted in FIG. 6A, the second slide portion 53 extends from a lower end portion of a front wall of the cover portion 51 forwardly and upwardly, while curving. The second slide portion 53 extends in the left-right direction. The second slide portion 53 has a generally cylindrical sector shape in side view with closed left and right end portions. Although not illustrated, a right end portion of the second slide portion 53 is located further toward the left than the right end portion of the cover portion 51 and a left end portion of the second slide portion 53 is located further toward the right than the left end portion of the cover portion 51. As depicted in FIG. 4A, the second slide portion 53 includes guide ribs, e.g., a plurality of second guide ribs 53A.

The second guide ribs 53A are spaced apart from each other in the left-right direction. Each second guide rib 53A protrudes from an outer peripheral surface of the second slide portion 53 and extends along the rotation direction of the endless belt 21.

Figure 3A:
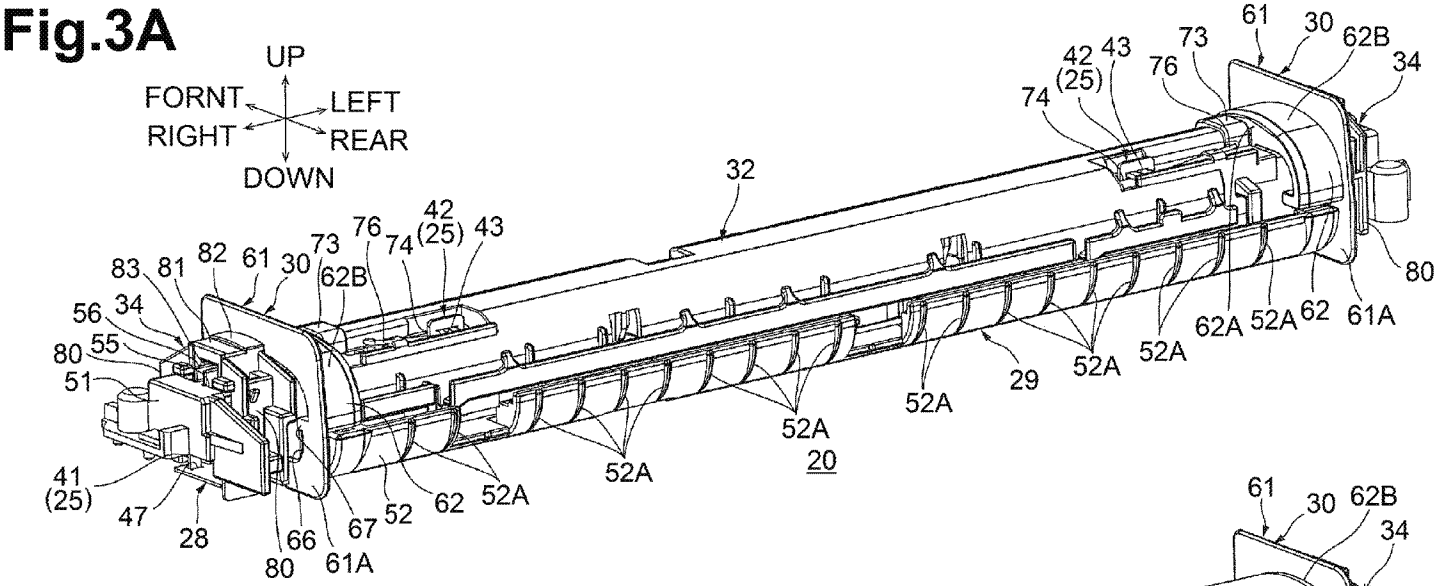
FIG. 3A is a perspective view of the heating unit depicted in FIG. 1, as viewed from an upper right side, wherein a halogen heater and a wiring are omitted for simplicity.

As depicted in FIGS. 3A and 6A, the stay cover 29 receives the stay 25, the reflective plate 26, the halogen heater 27 and the nip plate 28 inside the cover portion 51. At this time, each of the three second catches 48 of the nip plate 28 engages a corresponding one of engaged portions (not depicted) of the cover portion 51 of the stay cover 29, and each of the two upright portions 42 of the stay 25 is inserted from below into a corresponding one of the first insertion holes 57. Thus, the stay 25, the reflective plate 26, the halogen heater 27, and the nip plate 28 are positioned relative to the stay cover 29.

As depicted in FIGS. 2 and 3A, the pressing cover 32 includes the same material as that of the stay cover 29. The pressing cover 32 extends in the left-right direction and has a generally rectangular tubular shape with an open lower end. The pressing cover 32 includes engaged portions, e.g. two pressing portions 73, and two second insertion holes 74.

The two pressing portions 73 are disposed at respective left and right end portions of an upper wall of the pressing cover 32. Each pressing portion 73 extends in the left-right direction and has a generally rectangular tubular shape with an open lower end.

The two second insertion holes 74 are located with a space therebetween in the left-right direction. One of the second insertion holes 74 is disposed in a generally central portion, in the left-right direction, of a left half of the pressing cover 32, and the other one of the second insertion holes 74 is disposed in a generally central portion, in the left-right direction, of a right half of the pressing cover 32. Each second insertion holes 74 passes through a rear end portion of the upper wall of the pressing cover 32 and has a generally rectangular shape extending in the left-right direction in plan view.

Figure 5A:
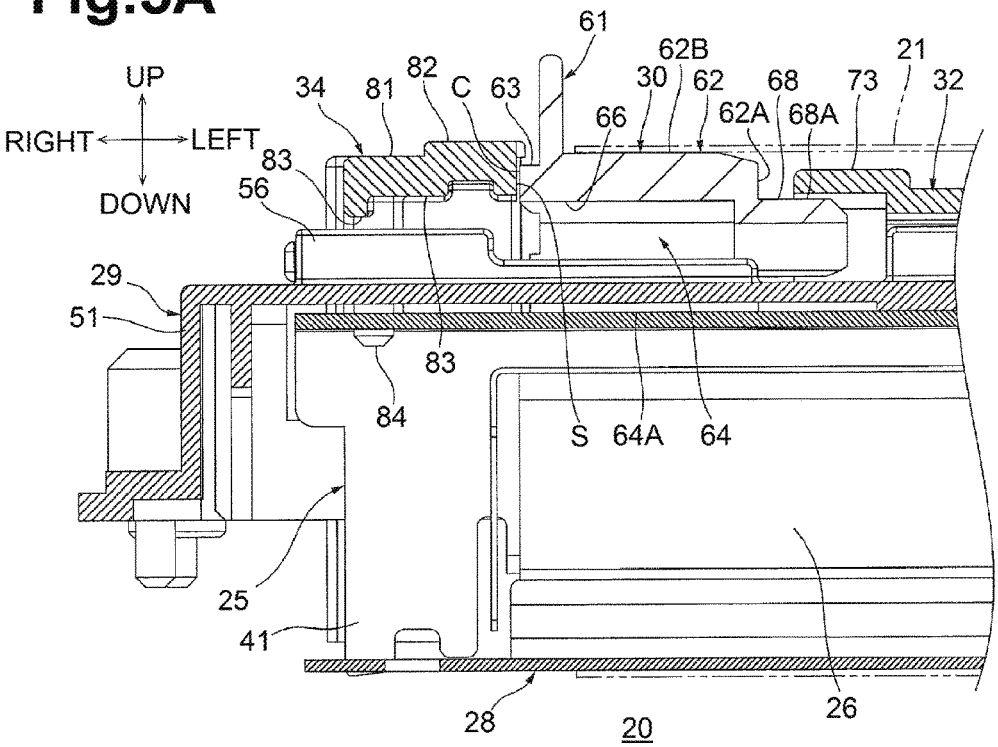
FIG. 5A is a cross-sectional view taken along a line A-A of FIG. 4A, wherein the halogen heater and the wiring are omitted for simplicity.

As depicted in FIGS. 3A and 5A, the pressing cover 32 is attached to the stay cover 29 with the cover portion 51 of the stay cover 29 placed inside the pressing cover 32.

As depicted in FIG. 2, each of the two second insertion holes 74 overlaps with a corresponding one of the first insertion holes 57 of the stay cover 29 in the top-bottom direction. With this structure, as depicted in FIG. 3A, each of the two upright portions 42 of the stay 25 is inserted from below into a corresponding one of the second insertion holes 74.

Each of two stopper pins 76 formed of a wire rod, is inserted into the through hole 43 of a corresponding one of the upright portions 42, so that the pressing cover 32 is fixed to the stay 25 with the stay cover 29 placed therebetween.

The stay cover 29 and the pressing cover 32 are configured as an example of a frame.

Each of the two belt guides 30 is disposed outside the pressing cover 32 in the left-right direction. As depicted in FIGS. 2 and 3A, each belt guide 30 includes a restriction portion 61, an inner guide 62, an engaging portion 68, a protruding portion 63, and two guide protrusions 64, as an example of a guided portion and a protrusion. The restriction portion 61, the inner guide 62, the engaging portion 68, the protruding portion 63, and the guide protrusions 64 are integrally provided as one unit. The inner guide 62 is also an example of an upper belt guide.

As depicted in FIG. 2, the restriction portion 61 has a generally rectangular plate shape, in side view, having a thickness in the left-right direction. The restriction portion 61 includes a first restriction portion 61A, a second restriction portion 61B, and a recessed portion 66.

Figure 5B:
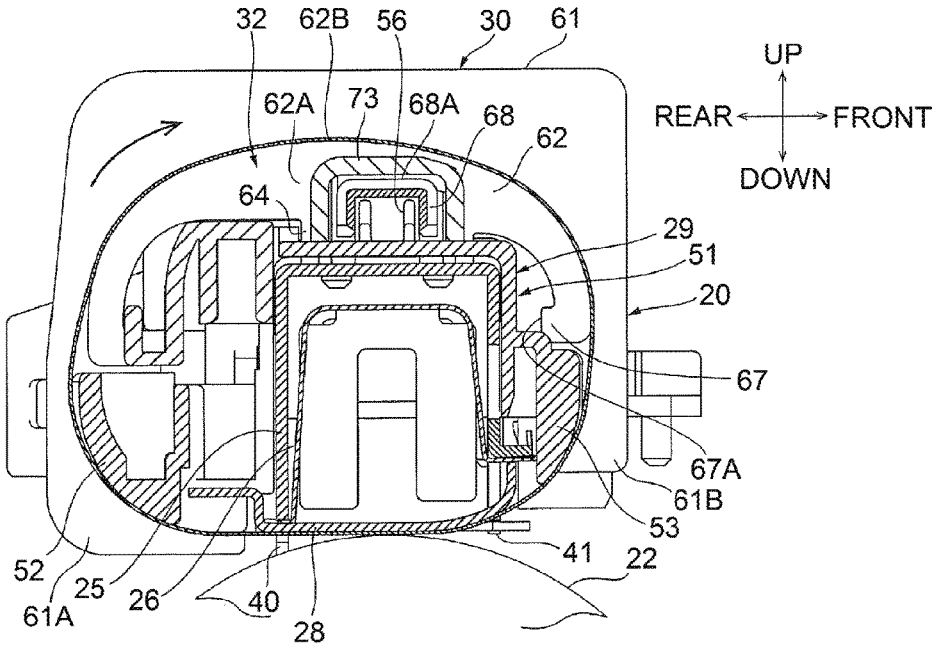
FIG. 5B is a cross-sectional view taken along a line B-B of FIG. 4A, wherein the halogen heater and the wiring are omitted for simplicity.

The first restriction portion 61A is disposed at a downstream side in the sheet conveying direction, e.g., a rear end portion of the restriction portion 61, as depicted in FIGS. 2 and 5B. The first restriction portion 61A has a generally L-shaped plate shape, in side view, extending downward and then frontward.

The second restriction portion 61B is disposed at an upstream side in the sheet conveying direction, e.g., a front end portion the restriction portion 61. The second restriction portion 61B has a generally rectangular plate shape extending downward in side view.

As depicted in FIG. 2, the recessed portion 66 is formed by cutting the restriction portion 61 from its lower end to its generally central portion, such that the recessed portion 66 has a generally U shape in side view with an open lower end. A dimension of the recessed portion 66 in the front-rear direction is greater than a dimension of the cover portion 51 of the stay cover 29 in the front-rear direction.

The inner guide 62 is connected to the restriction portion 61. The inner guide 62 is disposed at a position above a generally central portion of the restriction portion 61 in the top-bottom direction. The inner guide 62 extends inwardly in the left-right direction from an inner surface of the restriction portion 61 in the left-right direction. The inner guide 62 has a generally semi-cylindrical shape with an open lower end. For example, the first restriction portion 61A and the second restriction portion 61B of the restriction portion 61 are disposed closer to the first slide portion 52 and the second slide portion 53, respectively, than the inner guide 62 in the top-bottom direction. An inner end surface 62A of the inner guide 62 in the left-right direction may be an example of a second surface. An outer peripheral surface 62B of the inner guide 62 may be an example of a fourth surface. The inner guide 62 includes two bent portions 67, e.g., front and rear bent portions 67.

As depicted in FIGS. 2 and 6A, each of the two bent portions 67 extends inwardly in the front-rear direction from a respective one of front and rear lower end portions of the inner guide 62. An inner end surface 67A of the front bent portion 67 in the front-rear direction may be an example of a fifth surface. An inner end surface 67A of the rear bent portion 67 in the front-rear direction may be an example of a sixth surface.

As depicted in FIGS. 2 and 5A, the engaging portion 68 protrudes inwardly in the left-right direction from a generally central portion, in the front-rear direction, of an upper end portion of the inner end surface 62A of the inner guide 62. As depicted in FIGS. 5A and 5B, the engaging portion 68 has a generally rectangular tubular shape with an open lower end. A dimension of the engaging portion 68 in the front-rear direction is smaller than a dimension of the pressing portion 73 in the front-rear direction.

As depicted in FIGS. 2 and 4A, the protruding portion 63 is disposed above the recessed portion 66 of the restriction portion 61. The protruding portion 63 protrudes outward in the left-right direction from an outer surface of the restriction portion 61 in the left-right direction. The protruding portion 63 includes a curved surface C extending in front-rear direction, from a central portion thereof in front-rear direction, while curving, inward in the left-right direction, e.g., toward the outer surface of the restriction portion 61 in the left-right direction, when viewed from above. For example, the curved surface C is convexly curved.

The curved surface C is defined by continuing faces having different angles from each other. The curved surface C may be an example of a first surface.

As depicted in FIGS. 2 and 6A, the two guide protrusions 64, e.g., front and rear guide protrusions 64, are disposed at generally central portions of the belt guide 30 in the front-rear direction with a space therebetween in the front-rear direction. Each guide protrusion 64 protrudes downward from a generally central portion, in the front-rear direction, of an inner peripheral surface of a corresponding inner guide 62, and a generally central portion, in the front-rear direction, of an inner peripheral surface of a corresponding restriction portion 61. The guide protrusion 64 is a generally plate-shaped rib having a generally rectangular shape extending in the left-right direction in front view. As depicted in FIG. 6A, distance in the front-rear direction between the two guide protrusions 64 is greater than a dimension of the holding portion 56 in the front-rear direction and smaller than a dimension of the guide groove 55 in the front-rear direction. A lower surface 64A of the guide protrusion 64 may be an example of a third surface. A front surface 64B of the front guide protrusion 64 may be an example of a fifth surface. A rear surface 64C of the rear guide protrusion 64 may be an example of a sixth surface.

Each of the two belt guides 30 is attached to the stay cover 29 such that the guide protrusions 64 are received in the corresponding guide groove 55 of the stay cover 29 and the engaging portion 68 engages the corresponding pressing portion 73 of the pressing cover 32.

Thus, the front surface 64B of the front guide protrusion 64 faces a front edge of the guide groove 55, and the rear surface 64C of the rear guide protrusion 64 faces a rear edge of the guide groove 55.

As depicted in FIGS. 3A and 6A, in the belt guide 30, a lower rear end portion of the inner guide 62 faces an upper end portion of the first slide portion 52 in the top-bottom direction, and a lower front end portion of the inner guide 62 faces an upper end portion of the second slide portion 53 in the top-bottom direction.

As depicted in FIGS. 3A and 5B, in the belt guide 30, the first restriction portion 61A faces, in the left-right direction, a corresponding one of the left and right ends of the first slide portion 52, and the second restriction portion 61B faces, in the left-right direction, a corresponding one of the left and right ends of the second slide portion 53. A lower end portion of the first restriction portion 61A is located below the nip plate 28 and overlaps with a rear end portion of the nip plate 28 when viewed from the left-right direction. A lower end portion of the second restriction portion 61B is located in front of and at least partially above a front end portion of the nip plate 28 when viewed from the left-right direction.

As depicted in FIG. 6A, the lower surfaces 64A of the guide protrusions 64 face an upper wall of the stay 25 in the top-bottom direction.

As depicted in FIG. 5A, an upper surface 68A of the engaging portion 68 faces an upper wall of the pressing portion 73 in the top-bottom direction.

As depicted in FIG. 5B, front and rear ends of the engaging portion 68 face an inner surface of the pressing portion 73 in the front-rear direction with a slight space therebetween.

As depicted in FIG. 5A, the inner end surface 62A of the inner guide 62 in the left-right direction faces an outer surface of the pressing portion 73 in the left-right direction.

As depicted in FIG. 6A, the inner end surfaces 67A of the respective two bent portions 67 face an outer surface of the cover portion 51 of the stay cover 29 in the front-rear direction. For example, the inner end surfaces 67A of the two bent portions 67 face each other in the front-rear direction such that the stay cover 29 is placed therebetween.

Figure 6B:
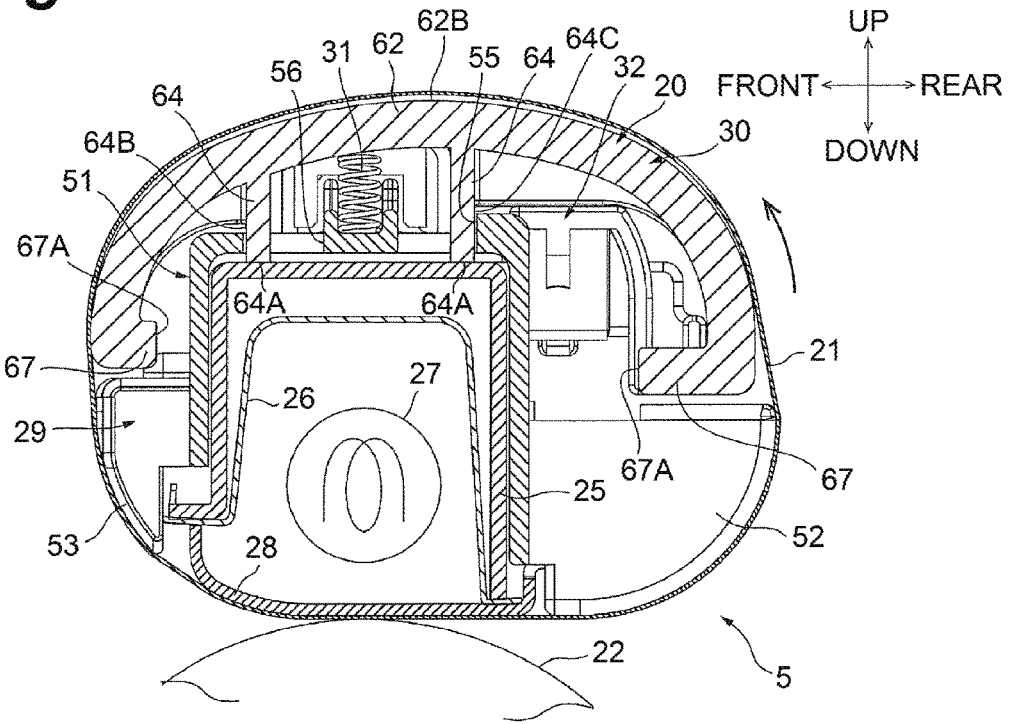
FIG. 6B is a cross-sectional view taken along the line C-C of FIG. 4B, wherein the belt guide is in a first position.

With this structure, the belt guide 30 is configured to move, while being guided by the guide groove 55 in the top-bottom direction, between a first position, as depicted in FIG. 6B, in which the lower surfaces 64A of the guide protrusions 64 contact the upper wall of the stay 25, and a second position, as depicted in FIG. 6A, in which the lower surfaces 64A of the guide protrusions 64 are separated from the upper wall of the stay 25.

As depicted in FIGS. 2 and 6A, each of two urging members 31 is disposed at a respective one of left and right end portions of the heating unit 20 and a generally central portion of the heating unit 20 in the front-rear direction. Each urging member 31 may be a coil spring formed from a wire coiled helically along the top-bottom direction. The urging member 31 is disposed between the two guide protrusions 64. As depicted in FIG. 6A, the urging member 31 is accommodated in the holding portions 56 such that a lower end portion of the urging member 31 contacts an upper surface of the holding portions 56 and an upper end portion of the urging member 31 contacts the inner peripheral surface of the inner guide 62 of the belt guide 30. Accordingly, the urging member 31 always urges the belt guide 30 upward. For example, the urging member 31 urges a generally central portion, in the front-rear direction, of the inner peripheral surface of the inner guide 62 of the belt guide 30 and urges the belt guide 30 upward, e.g., along the arrangement direction of the heating unit 20 and the pressure roller 22, toward a direction away from the pressure roller 22. For example, the guide groove 55 is configured to guide the movement of the belt guide 30 from the first position toward the second position as the belt guide 30 is urged by the urging member 31.

Figure 4B:
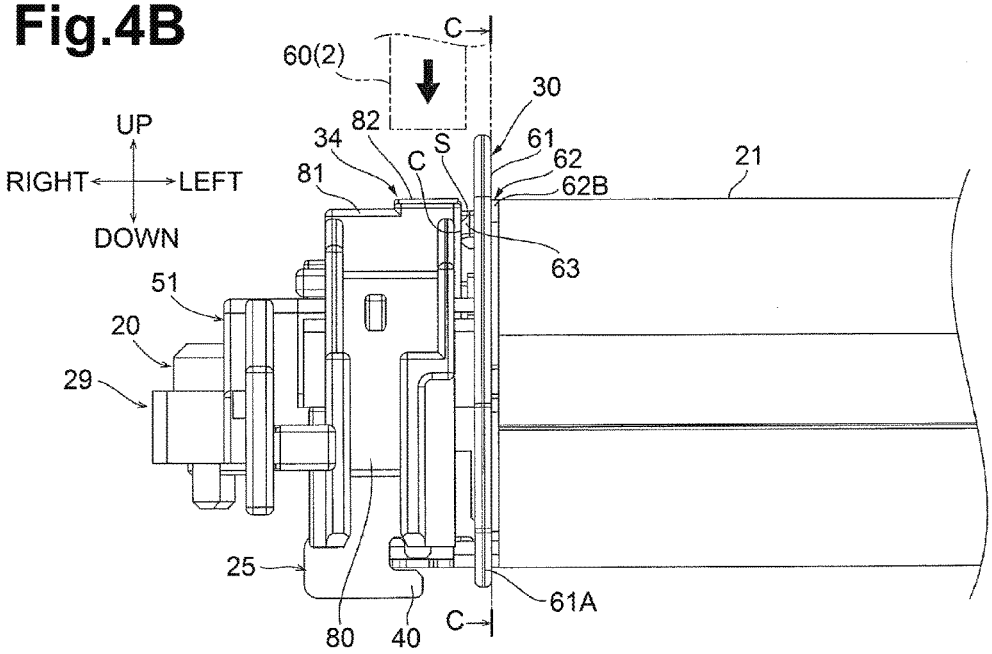
FIG. 4B a partially enlarged rear view of the heating unit, depicted in FIG. 3B, around which the endless belt is placed.

As depicted in FIG. 3A, in the heating unit 20, each of two opposing members 34 is disposed further outward in the left-right direction than a corresponding one of the belt guides 30. Each opposing member 34 is configured to press the nip plate 28 toward the pressure roller 22 as the opposing member 34 receives pressing force from a pressing mechanism 90, as depicted in FIG. 4B, provided in the main casing 2. The opposing member 34 includes two leg portions 80 and a connecting portion 81 as depicted in FIG. 2.

The two leg portions 80 are disposed with a space therebetween in the front-rear direction. Each leg portions 80 has a generally rectangular column shape extending in the top-bottom direction. Distance in the front-rear direction between the two leg portions 80 is greater than a dimension of the cover portion 51 of the stay cover 29 in the front-rear direction.

The connecting portion 81 connects between upper end portions of the leg portions 80. The connecting portion 81 has a generally rectangular column shape extending in the front-rear direction. The connecting portion 81 includes a bearing portion 82, a receiving portion 83, and two positioning protrusions 84.

The bearing portion 82 is disposed at an inner side of the connecting portion 81 in the left-right direction. The bearing portion 82 protrudes upward from a generally central portion of the connecting portion 81 in the front-rear direction. The bearing portion 82 has a generally arc shape in side view. For example, a peripheral surface of the bearing portion 82 has a curved shape. The bearing portion 82 is configured to bear or receive pressing force from the pressing mechanism 90 of the main casing 2.

The receiving portion 83 is recessed into the connecting portion 81 in an upward direction from a generally central portion of the connecting portion 81 in the front-rear direction.

The two positioning protrusions 84 are disposed with a space therebetween across the receiving portion 83 in the front-rear direction. Each positioning protrusion 84 has a generally cylindrical shape protruding downward from a lower surface of the connecting portion 81. Distance between the two positioning protrusions 84 in the front-rear direction is greater than a dimension of the holding portion 56 in the front-rear direction and is smaller than a dimension of the guide groove 55 in the front-rear direction.

A contact surface, e.g., a contact surface S, is provided at an inner surface of the opposing member 34 in the left-right direction above the receiving portion 83. The contact surface S has a planar shape.

As depicted in FIG. 4A, each of the two opposing members 34 is arranged to face an outer surface, in the left-right direction, of a corresponding one of the belt guides 30. In one example, as depicted in FIG. 2, each opposing member 34 is attached to the stay cover 29 such that two leg portions 80 sandwich the cover portion 51 of the stay cover 29 therebetween in the front-rear direction, the receiving portion 83 receives the corresponding holding portion 56, and the two positioning protrusions 84 are inserted into the corresponding guide groove 55.

As depicted in FIGS. 4A and 4B, the opposing member 34 is disposed with a slight space from the restriction portion 61 of the belt guide 30, and is in contact with the curved surface C of the protruding portion 63 of the belt guide 30 in the left-right direction at the contact surface S.

As depicted in FIG. 2, the wiring 35 extends from a right side of the heating unit 20. The wiring 35 is a conductor for power supply to the halogen heater 27. The wiring 35 is routed between the stay cover 29 and the pressing cover 32, and connected to an electrode disposed at each left and right portion of the halogen heater 27.

(2) Endless Belt

Figure 3B:
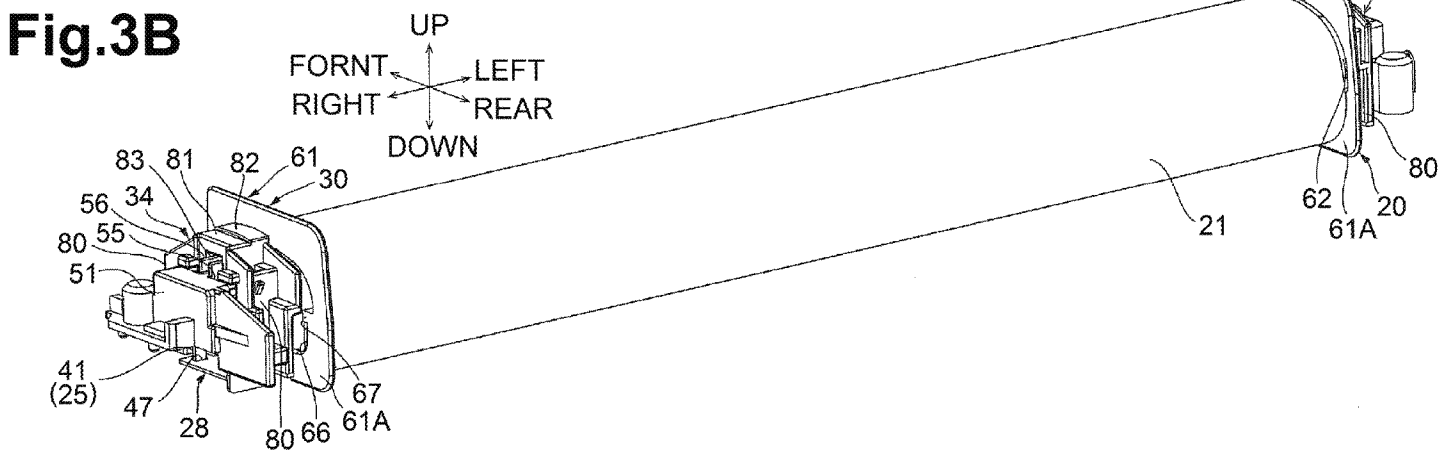
FIG. 3B is a perspective view of the heating unit depicted in FIG. 1, as viewed from an upper right side, around which an endless belt is placed, wherein the halogen heater and the wiring are omitted for simplicity.

The endless belt 21 is a heat-resistant and flexible film, and has a tubular shape extending in the left-right direction, as depicted in FIGS. 3B and 6A. The endless belt 21 is disposed around the heating unit 20 such that an inner surface of the belt 21 contacts the lower surface of the nip plate 28. The endless belt 21 is configured to rotate counterclockwise in right side view.

A lower rear end portion of the endless belt 21 is in contact with a peripheral surface of the first slide portion 52 to allow the endless belt 21 to be guided by the peripheral surface of the first slide portion 52. A lower front end portion of the endless belt 21 is in contact with a peripheral surface of the second slide portion 53 to allow the endless belt 21 to be guided by the peripheral surface of the second slide portion 53.

An upper end portion of each left and right end of the endless belt 21 is in contact with the outer peripheral surface 62B of the inner guide 62 of a corresponding belt guide 30. For example, the inner guide 62 is urged upward by the urging member 31, so that tension may be applied to the endless belt 21.

Each of left and right end portions of the endless belt 21 face an inner surface, in the left-right direction, of the restriction portion 61 of a corresponding belt guide 30.

(3) Pressure Roller

The pressure roller 22 includes an elastic material, e.g., rubber, and has a generally cylindrical shape extending in the left-right direction, as depicted in FIG. 1. The pressure roller 22 contacts an outer peripheral surface of the endless belt 21 such that the endless belt 21 is sandwiched between the nip plate 28 of the heating unit 20 and the pressure roller 22. The pressure roller 22 is supported by the main casing 2 to rotate clockwise in right side view in response to receiving drive force from a drive source (not depicted).

3. Assembly of Heating Unit and Endless Belt

To assemble the heating unit 20 and the endless belt 21, first the reflective plate 26 and the halogen heater 27 are located inside the stay 25, as depicted in FIG. 6A.

Each of the three first catches 46 of the nip plate 28 is hooked on a corresponding one of the hook-shaped portions 40 of the stay 25, and the through hole 47 of the nip plate 28 receives the extending portion 41 of the stay 25.

Thus, the reflective plate 26, the halogen heater 27, and the nip plate 28 are attached to the stay 25.

Then, as depicted in FIGS. 2 and 3A, the stay cover 29 is attached to the stay 25 by inserting each of the two first insertion holes 57 over a corresponding one of the upright portions 42 of the stay 25.

Then, the wiring 35 is disposed above the upper wall of the stay cover 29, and connected to the electrodes of the halogen heater 27 disposed at respective left and right end portions thereof.

Then, the pressing cover 32 is attached to the stay cover 29 such that the wiring 35 is placed between the stay cover 29 and the pressing cover 32 and each of the upright portions 42 of the stay 25 is inserted into a corresponding one of the two second insertion holes 74.

Each of the stopper pins 76 is inserted into a corresponding one of the through holes 43 of the upright portions 42 of the stay 25, so that the pressing cover 32 is fixed to the stay 25 with the stay cover 29 placed therebetween.

Then, the stay 25, the reflective plate 26, the halogen heater 27, the nip plate 28, the stay cover 29, and the pressing cover 32 that are attached to each other, are inserted into the endless belt 21 from its outside in the left-right direction, as depicted in FIGS. 3B and 4A.

At this time, the endless belt 21 is attached such that a right end portion of the endless belt 21 is located further toward the right than a right end portion of the pressing cover 32 and a left end portion of the endless belt 21 is located further toward the left than a left end portion of the pressing cover 32.

Then, the two belt guides 30 and the two urging members 31 are attached to the stay cover 29 outside the endless belt 21 in the left-right direction.

In one example, as depicted in FIGS. 2 and 6A, the belt guides 30 are attached to the stay cover 29 such that each urging member 31 is disposed into a respective holding portion 56, and the two guide protrusions 64 of the respective belt guides 30 engage in outer end portions of the corresponding guide groove 55 in the left-right direction.

Then, each belt guide 30 is slidably moved inward in the left-right direction while the two guide protrusions 64 are guided by the corresponding guide groove 55.

Thus, each inner guide 62 is disposed inside the endless belt 21, as depicted in FIG. 5A, with the outer peripheral surface 62B of the inner guide 62 in contact with an inner peripheral surface of the endless belt 21 and the engaging portion 68 of the belt guide 30 placed in the pressing portions 73.

Then, the two opposing members 34 are attached to the stay cover 29 from above, such that each opposing member 34 is placed outside a corresponding one of the belt guides 30 in the left-right direction, as depicted in FIG. 3A.

Thereafter, the two leg portions 80 sandwich the cover portion 51 of the stay cover 29 therebetween in the front-rear direction, and the two positioning protrusions 84 are inserted into outer end portions of the corresponding guide groove 55 in the left-right direction. Thus, each belt guide 30 is positioned relative to the stay cover 29.

Thus, as depicted in FIGS. 4A and 4B, the curved surface C of the protruding portion 63 of the belt guide 30 contacts the contact surface S of the opposing member 34.

Thus, assembly of the heating unit 20 and the endless belt 21 completes.

4. Operations of Fixing Device

In an image forming operation, the endless belt 21 between the nip plate 28 and the pressure roller 22 is heated by the nip plate 28 that is heated by radiant heat from the halogen heater 27.

As the image forming operation starts, the pressure roller 22 rotates clockwise in FIGS. 6A and 6B, with drive force from the main casing 2. Then, the endless belt 21 rotates counterclockwise in right side view, in response to the rotation of the pressure roller 22. For example, the endless belt 21 moves rearward between the nip plate 28 and the pressure roller 22.

At this time, the endless belt 21 may shift in the left-right direction due to passage of a sheet P between the endless belt 21 and the pressure roller 22 or pressure differences in the pressure roller 22 between left and right sides thereof.

As the endless belt 21 shifts in the left-right direction, an end of the endless belt 21 in the left-right direction, as depicted in FIGS. 4A and 4B, may rotate while contacting an inner surface of the restriction portion 61 of the belt guide 30 in the left-right direction.

In this case, the curved surface C of the protruding portion 63 of the belt guide 30 is in contact with the contact surface S of the connecting portion 81 of the opposing member 34. Therefore, the belt guide 30 pivots about a contact portion between the contact surface S and the curved surface C in plan view.

The belt guide 30 is constantly urged upward, as depicted in FIG. 6A, by the urging member 31. Therefore, the belt guide 30 is configured to move in a direction other than the top-bottom direction, without moving in the top-bottom direction.

5. Effects (1) In the fixing device 5, as depicted in FIG. 3A, the inner guides 62 of the belt guides 30 face left and right end portions of each of the first slide portion 52 and the second slide portion 53 of the stay cover 29 in the top-bottom direction. Therefore, a displacement in the left-right direction between the stay cover 29 and the belt guide 30 may be reduced or prevented.

The first restriction portion 61A and the second restriction portion 61B of the restriction portion 61 of the belt guide 30 extend closer to the first slide portion 52 and the second slide portion 53 of the stay cover 29, respectively, than the inner guide 62 in the top-bottom direction. Therefore, movement of the endless belt 21 in the left-right direction may be reliably restricted.

Consequently, left and right end portions of the endless belt 21 may be reliably guided by the first slide portion 52, the second slide portion 53, and the inner guide 62, and movement of the endless belt 21 in the left-right direction may be reliably restricted. Accordingly, the endless belt 21 may be rotated stably.

(2) In the fixing device 5, as depicted in FIG. 5B, the first restriction portion 61A extends to the nip plate 28 while bending. Therefore, shift of the endless belt 21, in the left-right direction, that is guided at a downstream side of the nip plate 28 in the conveying direction of the sheet P, may be reliably regulated.

Accordingly, the endless belt 21 may rotate more stably.

(3) In the fixing device 5, even when the second restriction portion 61B and the nip plate 28 are disposed with a distance therebetween in the top-bottom direction, as depicted in FIG. 5B, the endless belt 21, whose movement in the left-right direction is restricted by the second restriction portion 61B, rotates toward a portion between the nip plate 28 and the pressure roller 22. Therefore, while the belt guide 30 is reduced in size, movement of the endless belt 21 in the left-right direction may be reliably restricted by the first restriction portion 61A.

(4) In the fixing device 5, friction between the endless belt 21 and the first slide portion 52 may be reduced with the first guide ribs 52A, and friction between the endless belt 21 and the second slide portion 53 may be reduced with the second guide ribs 53A, as depicted in FIG. 4A.

(5) In the fixing device 5, with such a simple structure that the guide protrusions 64 engage in the groove 55, as depicted in FIGS. 2 and 6A, the belt guide 30 may be guided along the top-bottom direction relative to the stay cover 29.

(6) In the fixing device 5, the wiring 35 configured to supply power to the halogen lamp 27 for heating the nip plate 28 is disposed between the stay cover 29 and the pressing cover 32, as depicted in FIG. 2, so that the wiring 35 may be protected.

The stay cover 29 is disposed between the nip plate 28 and the pressing cover 32. Therefore, heat transfer from the nip plate 28 to the pressing cover 32 may be reduced or prevented. Accordingly, thermal deformation of the pressing portion 73, of the pressing cover 32, configured to engage the engaging portion 68 of the belt guide 30, may be reduced or prevented.

(7) In the fixing device 5, the inner guide 62 may reliably be brought into contact with an inner surface of the endless belt 21 by the urging member 31, as depicted in FIG. 6A.

Accordingly, tension may be applied to the endless belt 21, and bending or sagging of the endless belt 21 may be reduced or prevented.

(8) In the fixing device 5, as depicted in FIG. 6A, the inner guide 62 is urged upward, e.g., away from the pressure roller 22, by the urging member 31, so that tension may be applied to the endless belt 21.

For example, tension may be applied to a portion of the endless belt 21 that may readily bend or sag, e.g., a portion of the endless belt 21 that is not held between the nip plate 28 and the pressure roller 22, sagging of the endless belt 21 may reliably be reduced or prevented.

(9) In the fixing device 5, as depicted in FIG. 6A, the inner guide 62 is urged with such a simple structure that the urging member 31 is disposed between the stay 25 and the inner guide 62 of the belt guide 30, to apply tension to the endless belt 21.

Accordingly, bending or sagging of the endless belt 21 may be readily reduced or prevented.

(10) In the fixing device 5, as depicted in FIG. 6A, a generally central portion of the inner guide 62 is urged by the urging member 31, so that tension may be efficiently applied to the endless belt 21.

(11) In the fixing device 5, the urging member 31 is the spring, as depicted in FIGS. 2 and 6A. Therefore, with a simple structure, the inner guide 62 may be urged and tension may be applied to the endless belt 21.

(12) In the fixing device 5, without providing a heat-conductor wire for the nip plate 28 itself, the nip plate 28 may be heated indirectly by the halogen heater 27, as depicted in FIGS. 2 and 6A.

6. Second Illustrative Embodiment

Figure 7:
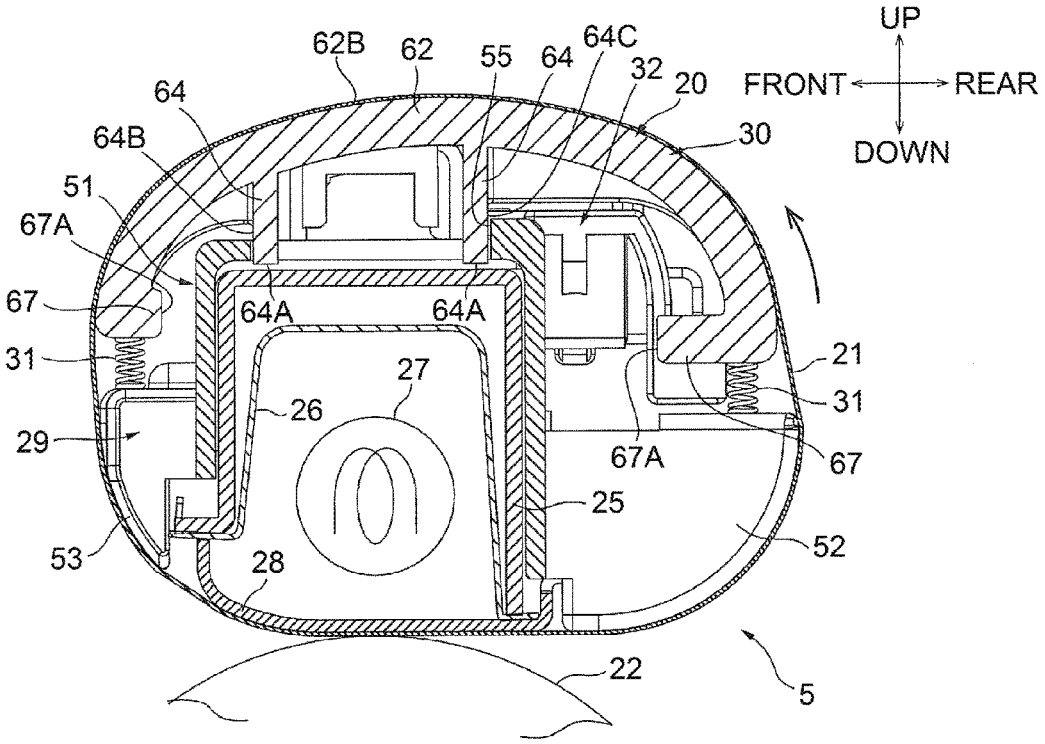
FIG. 7 is a cross-sectional view of a fixing device in a second illustrative embodiment.

A fixing device 5 according to a second illustrative embodiment of the disclosure will be described referring to FIG. 7. Like reference numerals denote like corresponding parts and detailed description thereof with respect to the second illustrative embodiment may be omitted herein.

In the fixing device 5 according to the first illustrative embodiment, the urging member 31 is disposed at a generally central portion in the front-rear direction, as depicted in FIG. 6A, such that a lower end portion of the urging member 31 contacts the holding portion 56 of the cover portion 51 of the stay cover 29, and an upper end portion of the urging member 31 contacts the inner peripheral surface of the inner guide 62 of the belt guide 30.

In the fixing device 5 according to the second illustrative embodiment of the disclosure, two urging members 31 are provided for one belt guide 30, between a lower rear end portion of the inner guide 62 and an upper end portion of the first slide portion 52, and between a lower front end portion of the inner guide 62 and an upper end portion of the second slide portion 53. For example, each of the two urging members 31 is disposed at a respective one of downstream and upstream sides in the rotation direction of the endless belt 21.

In the fixing device 5 according to the second illustrative embodiment, tension may be applied to the endless belt 21 in a balanced manner using the two urging members 31.

What is claimed is:

1. A fixing device, comprising:

an endless belt having a tubular shape and extending in a first direction;

a heating plate disposed inside the endless belt and extending in the first direction;

a pressure roller contacting an outer peripheral surface of the endless belt such that the endless belt is disposed between the pressure roller and the heating plate;

a first belt guide configured to guide an end of the endless belt in the first direction, the first belt guide including an inner guide disposed along a portion of an inner peripheral surface of the endless belt, and a restriction portion connected to the inner guide and disposed outside the endless belt in the first direction, the restriction portion configured to restrict movement of the endless belt in the first direction; and a second belt guide facing the first belt guide in a second direction in which the endless belt and the pressure roller face each other, the second belt guide being located at each end portion of the heating plate along the first direction and extending along the inner peripheral surface of the endless belt from a first position in which the heating plate is closer to the inner guide than a first end of the second belt guide is to the inner guide in the second direction to a second position in which a second end of the second belt guide is closer to the inner guide in the second direction than to the heating plate, and wherein an end of the restriction portion in the second direction closest to the heating plate is located closer to the second belt guide than the inner guide.

2. The fixing device according to claim 1, wherein a lower end of the restriction portion is closer to the pressure roller than a lower end of the second belt guide in the second direction.

3. The fixing device according to claim 1, wherein the restriction portion includes:

a first restriction portion disposed on a downstream side in a sheet conveying direction; and a second restriction portion disposed on an upstream side in the sheet conveying direction, and wherein the first restriction portion extends to the heating plate while bending.

4. The fixing device according to claim 3, wherein the second restriction portion extends straightly in the second direction, and is spaced apart from the heating plate in the second direction.

5. The fixing device according to claim 1, wherein an end portion of the second belt guide in a sheet conveying direction includes a plurality of guide ribs aligned in the first direction, each rib extending along a rotation direction of the endless belt.

6. The fixing device according to claim 1, further comprising a frame extending in the first direction and supporting the heating plate, the frame including the second belt guide and having a groove extending along the first direction, and wherein the first belt guide includes a protrusion configured to be guided by the groove by engaging the groove.

7. The fixing device according to claim 6, further comprising a wiring configured to supply power for heating the heating plate, wherein the first belt guide includes an engaging portion protruding inwardly in the first direction from an inner end portion of the inner guide in the first direction, the frame includes:

a first frame extending in the first direction and supporting the heating plate, the first frame including the second belt guide; and a second frame extending in the first direction and disposed opposite to the heating plate with respect to the first frame, the wiring is disposed between the first frame and the second frame, and the second frame includes an engaged portion configured to engage the engaging portion.

8. The fixing device according to claim 6, further comprising an urging member configured to urge the inner guide toward the endless belt.

9. The fixing device according to claim 8, wherein the urging member is configured to urge the first belt guide toward the second direction.

10. The fixing device according to claim 9, wherein the urging member is disposed between the frame and the inner guide.

11. The fixing device according to claim 10, wherein the urging member is disposed at a position corresponding to a generally central portion of the inner guide when viewed from the first direction.

12. The fixing device according to claim 10, wherein the urging member is disposed downstream and upstream, in a rotation direction of the endless belt, of a position corresponding to a generally central portion of the inner guide, respectively, when viewed from the first direction.

13. The fixing device according to claim 8, wherein the urging member includes a spring.

14. The fixing device according to claim 1, further comprising a halogen heater configured to heat the heating plate.

15. A fixing device, comprising:

an endless belt having a tubular shape and extending in a first direction;

a belt guide disposed along an inner peripheral surface of the endless belt and configured to guide the endless belt; and a restriction portion disposed outside the endless belt in the first direction and configured to restrict movement of the endless belt in the first direction, the restriction portion extending above an upper end of the endless belt and extending below a lower end of the endless belt.

16. The fixing device according to claim 15, the belt guide comprising:

an upper belt guide positioned in an upper portion of the belt guide when viewed from the first direction; and a lower belt guide positioned in a lower portion of the endless belt when viewed from the first direction, wherein the upper belt guide and the lower belt guide are separately formed.

17. The fixing device according to claim 16, wherein the upper belt guide and the restriction portion are integrally formed.

18. The fixing device according to claim 15, further comprising a pressure roller contacting an outer peripheral surface of the endless belt, a sheet being conveyed between the pressure roller and the endless belt in a sheet conveying direction, wherein the restriction portion extends outwardly and upstream of the endless belt in the sheet conveying direction.

19. The fixing device according to claim 18, wherein the restriction portion extends outwardly and downstream of the endless belt in the sheet conveying direction.

20. A fixing device, comprising:

an endless belt having a tubular shape and an inner peripheral surface and configured to rotate in a rotation direction, the endless belt extending in a first direction and extending along the rotation direction;

a heating plate disposed inside the endless belt and extending in the first direction;

a pressure roller contacting an outer peripheral surface of the endless belt such that the endless belt is disposed between the pressure roller and the heating plate;

a restriction portion disposed outside the endless belt in the first direction and configured to restrict movement of the endless belt in the first direction;

a first belt guide connected to the restriction portion and configured to guide an end of the endless belt in the first direction, the first belt guide being configured to guide a portion of the inner peripheral surface of the endless belt;

a second belt guide facing the first belt guide in a second direction in which the endless belt and the pressure roller face each other, the second belt guide extending in the first direction and being configured to guide a portion of the inner peripheral surface of the endless belt; and a third belt guide facing the first belt guide in the second direction, the third belt guide extending in the first direction and being configured to guide a portion of the inner peripheral surface of the endless belt, wherein the inner peripheral surface of the endless belt is configured to be entirely guided by the first belt guide, the second belt guide, the heating plate and the third belt guide in this order in the rotation direction.

* * * * *